US008241075B2

(12) United States Patent
Ishikawa et al.

(10) Patent No.: US 8,241,075 B2
(45) Date of Patent: Aug. 14, 2012

(54) TERMINAL FITTING

(75) Inventors: Ryotaro Ishikawa, Yokkaichi (JP); Kazuaki Takeda, Yokkaichi (JP); Katsuya Uezono, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/184,636

(22) Filed: Jul. 18, 2011

(65) Prior Publication Data

US 2012/0034827 A1 Feb. 9, 2012

(30) Foreign Application Priority Data

Aug. 6, 2010 (JP) ..... 2010-177312

(51) Int. Cl.
*H01R 11/22* (2006.01)

(52) U.S. Cl. ..... 439/851

(58) Field of Classification Search ..... 439/850–856, 439/861, 862, 839
See application file for complete search history.

(56) References Cited

U.S. PATENT DOCUMENTS 5,643,018 A 7/1997 Sakai et al.
5,788,542 A 8/1998 Miwa
5,839,925 A * 11/1998 Simmons ..... 439/852
5,941,741 A * 8/1999 Dobbelaere et al. ..... 439/852
6,244,910 B1 6/2001 Grubbs
6,478,636 B1 11/2002 Makita et al.
7,175,486 B2 * 2/2007 Noro et al. ..... 439/839
7,179,138 B2 * 2/2007 Nora et al. ..... 439/843
7,204,728 B2 * 4/2007 Noro et al. ..... 439/852
7,223,135 B2 * 5/2007 Nora et al. ..... 439/852
7,264,518 B2 * 9/2007 Ellis ..... 439/852
2006/0172617 A1 8/2006 Kobayashi et al.

* cited by examiner

*Primary Examiner* — Tulsidas C Patel
*Assistant Examiner* — Phuongchi Nguyen
(74) *Attorney, Agent, or Firm* — Gerald E. Hespos; Michael J. Porco

(57) ABSTRACT

A rectangular tubular terminal connecting portion (11) includes two side plates (17) standing up from opposite sides of a base plate (15) via curved portions (16). A resilient contact piece (20) includes a substantially arcuate turned portion (21) extending forward from a front end (15F) of the base plate (15) and a main portion (22) extending back from an extending end of the turned portion (21). First slits (24) extend back from a front end (11F) of the terminal connecting portion (11) along lateral edges (21S) of the turned portion (21), second slits (25) extend from the rear ends of the first slits (24) along the front ends (15F, 16F) of the base plate (15) and the curved portions (16), and protecting plates (26) defined by the first and second slits (24, 25) are cantilevered toward the turned portion (21).

5 Claims, 11 Drawing Sheets

TERMINAL FITTING

BACKGROUND OF THE INVENTION

1. Field of the Invention

The invention relates to a terminal fitting.

2. Description of the Related Art

U.S. Pat. No. 6,478,636 discloses a female terminal fitting including a rectangular tubular terminal connecting portion 100 with an open front end to receive a tab 111 of a mating terminal. A resilient contact piece 105 is disposed in the terminal connecting portion 100 for resiliently holding the tab 111 between an inner surface of the terminal connecting portion 100 and the resilient contact piece 105, as shown in FIGS. 9 and 10. The terminal connecting portion 100 includes a base plate 101 and two side plates 103 stand up substantially at right angles from the opposite lateral sides of the base plate 101 via quarter-circular curved portions 102. An upper plate 104 extends from the upper edges of the side plates 103 and is parallel to the base plate 101. The resilient contact piece 105 includes a substantially arcuate turned portion 106 extending forward from a front end 101F of the base plate 101 and a main portion 107 extending back from the extending end of the turned portion 106 and includes a contact portion 108 for contact with the tab 111.

The turned portion 106 of the resilient contact piece 105 projects forward (right in FIG. 9) from the front end 101F of the base plate 101 in the above-described terminal fitting. Front ends 103F of the side plates 103 project forward from the front end 101F of the base plate 101 to protect the turned portion 106. However, parts of the side plates 103 near the base plate 101 are cut out. Thus, the turned portion 106 is exposed in the cutouts 109 when viewed sideways, and it is difficult to protect the turned portion 106 reliably.

The parts of the side plates 103 corresponding to the turned portion 106 are cut out to partially expose the turned portion 106 because, in a developed state of the above terminal fitting, the cutouts 109 are formed between the turned portion 106 and the front ends 103F of the side plates 103, as shown in FIG. 11. To protect the turned portion 106, it is thought to change this developed shape and provide protecting plates 110 extending from the front ends 103F of the side plates 103 and front ends 102F of the curved portions 102 in the cutouts 109, as shown in FIG. 12.

The above-described change of shape causes lateral edges 110S of the protecting plates 110 extending along lateral edges 106S of the turned portion 106 to become free ends. Thus, the protecting plates 110 are deformed with strain when the curved portions 102 are formed to cause the side plates 103 to stand up from the base plate 101. That is, rear parts of the protecting plates 110 connected to the curved portions 102 are curved to have a shape close to the shape of the curved portions 102, whereas front parts thereof distant from the curved portions 102 are curved to a small degree. If the protecting plates 110 are deformed with strain in this way, front end portions of the protecting plates 110 may project out from the outer surface of the base plate 101. Therefore, conventionally, the protecting plates 110 have not been provided and the turned portion 106 has been left partially exposed through the cutouts 109.

The present invention was developed in view of the above situation and an object thereof is to reliably protect a turned portion of a resilient contact piece.

SUMMARY OF THE INVENTION

The invention relates to a terminal fitting that has a terminal connecting portion with an open front end to allow the entry of a tab of a mating terminal. A resilient contact piece is provided in the terminal connecting portion for resiliently electrically contacting the tab that has been inserted into the terminal connecting portion. The terminal connecting portion includes a base plate. Two side plates project from the base plate via curved portions, and a ceiling plate extends substantially parallel to the base plate. The resilient contact piece includes a turned portion that extends forward from the front end of the base plate and a main portion that extends back from the extending end of the turned portion. The main portion includes a contact for contacting the tab. A front end of the terminal connecting portion is formed with at least one first slit that extends substantially back from the front end of the terminal connecting portion along a lateral edge of the turned portion. At least one second slit extends substantially from the rear end of the first slit along the front end of the base plate and the front end edge of the curved portion. At least one protecting plate is defined by the first and second slits and is cantilevered toward the turned portion.

The turned portion of the resilient contact piece projects substantially forward from the front end edge of the base plate. However, the protecting plate is located before the front end of the base plate and protects the turned portion from interference of external matters. Further, the second slit separates the protecting plate from the curved portion and the protecting plate will not be deformed with strain upon forming the curved portion.

The terminal connecting portion preferably is a substantially rectangular or polygonal tube.

The resilient contact piece resiliently holds the tab between an inner surface of the terminal connecting portion and the resilient contact piece.

The ceiling plate preferably extends between upper ends of the side plates.

The protecting plates are substantially flat plates bent along folding lines extending in forward and backward directions to extend oblique to the side plates and the base plate. Thus, the protecting plates are formed easily as compared with the case where they are bent at plural positions or arcuately bent along the curved portions.

A front part of the side plate preferably projects forward from the base plate and the curved portion and protects the turned portion of the resilient contact piece.

A formation area of the first slit in forward and backward directions extends substantially from a front end of the terminal connecting portion to the front end of the base plate and/or the front end of the curved portions.

A formation area of the second slit in a direction at an angle to forward and backward directions extends from the lateral edge of the turned portion to a bottom end of the side plate, and hence along the entire curved portion.

The protecting plate preferably is adjacent the first slit and substantially opposite the turned portion.

The protecting plate preferably is at a side of the second slit substantially opposite to the base plate and the curved portion in forward and backward directions.

The protecting plate preferably is entirely located inwardly of the outer surfaces of the curved portion when viewed along the forward and backward directions.

An extending end edge of the protecting plate preferably is located in the vertical direction within the thickness range of the base plate and slightly above the outer surface of the bottom end of the turned portion.

The extending end edge of the protecting plate is in such a positional relationship in the width direction parallel to the base plate to be located inwardly of the curved portion and substantially proximate to the lateral edge of the turned portion.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
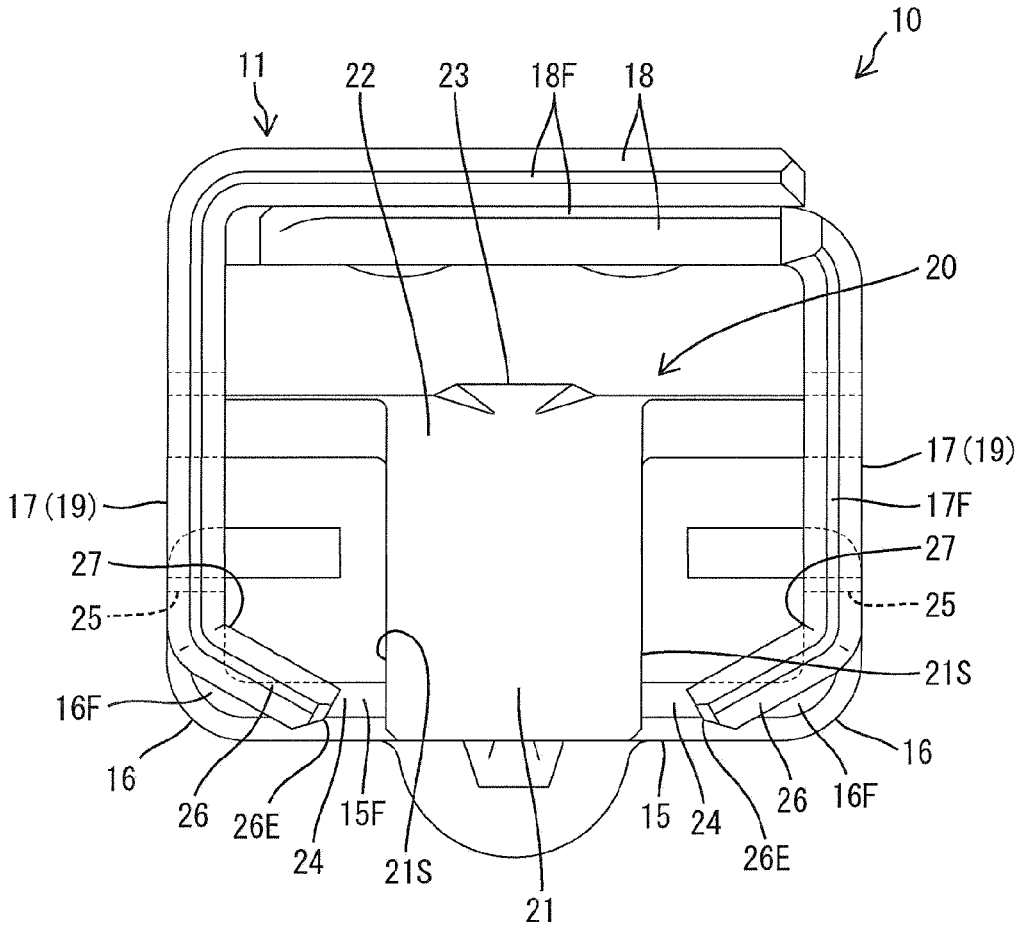
FIG. 1 is a front view of a terminal fitting according to one embodiment
Figure 2:
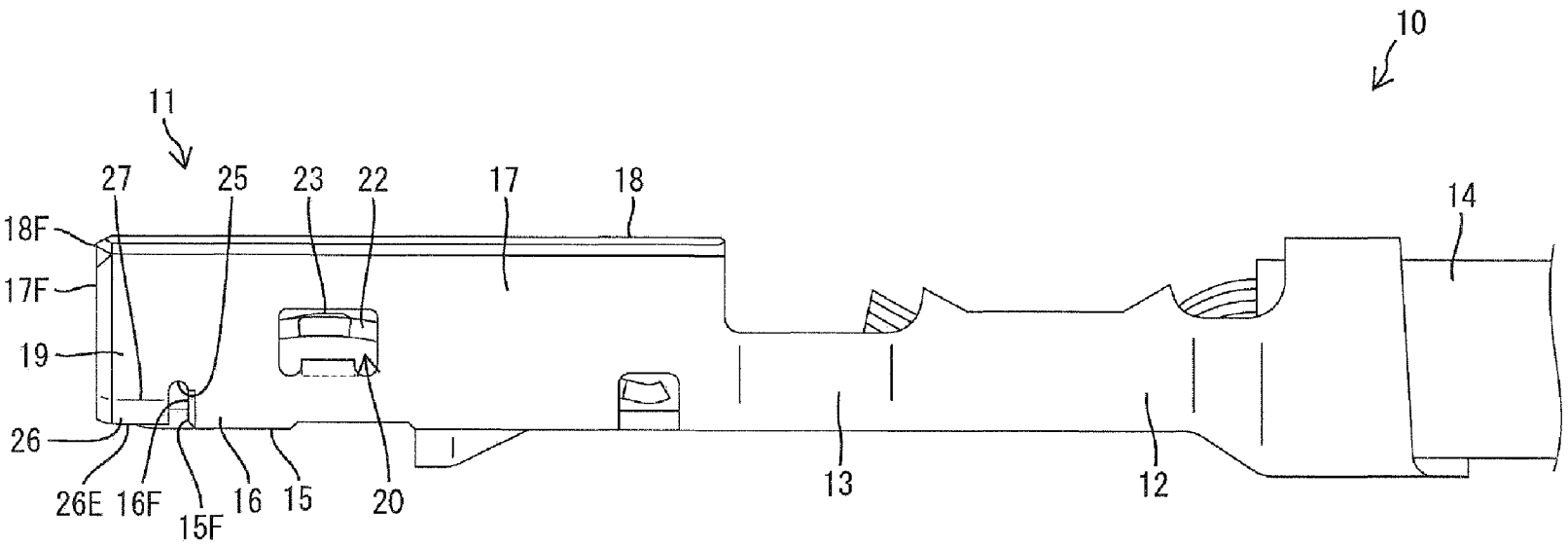
FIG. 2 is a side view of the terminal fitting.
Figure 3:
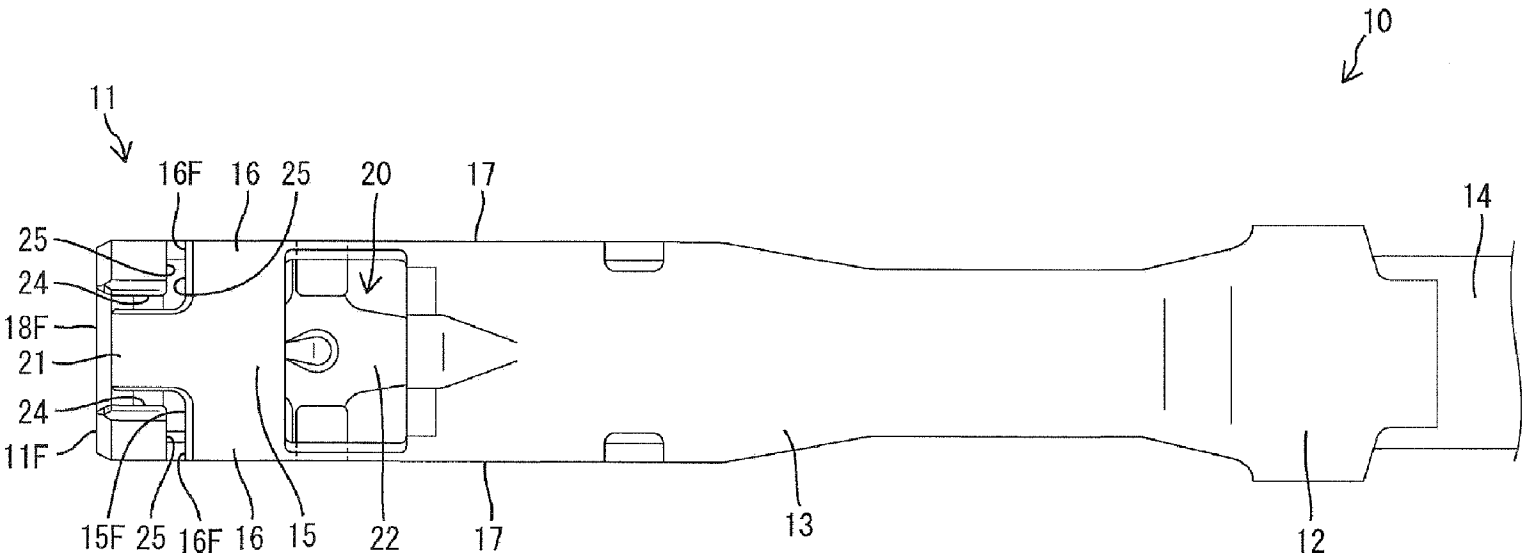
FIG. 3 is a bottom view of the terminal fitting.

A terminal fitting in accordance with the invention is identified by the numeral 10 in FIGS. 1 to 8. The terminal fitting 10 is a female terminal that is long and narrow in forward and backward directions, as shown in FIGS. 2 and 3, by bending, folding and/or embossing a conductive metal plate material punched or cut into a shape shown in FIG. 7. A terminal connecting portion 11 is formed at a front end (left end in FIGS. 2 to 6) and a wire connecting portion 12 is formed at a rear end. The rear end of the terminal connecting portion 11 and the front end of the wire connecting portion 12 are coupled via a coupling portion 13. The wire connecting portion 12 is crimped, bent or folded into electrically conductive connection to a leading end portion of a wire 14.

As shown in FIG. 1, the terminal connecting portion 11 defines a long narrow substantially rectangular tube with an open front end. More particularly, the terminal connecting portion 11 includes a base plate 15. Left and right substantially bilaterally symmetric curved portions 16 define substantially quarter-cylinders and project from opposite left and right sides of the base plate 15. Left and right substantially bilaterally symmetric side plates 17 extend up from upper ends of the curved portions 16. An upper wall 18 is defined by two plates extending from the upper ends of the side plates 17. The plates of the upper wall 18 are placed one over the other and are parallel to the base plate 15. The base plate 15, the side plates 17 and the upper plates 18 are substantially flat and are long and narrow in forward and backward directions. The left and right curved portions 16 also are long and narrow in forward and backward directions. The bottom ends of the curved portions 16 extend smoothly and tangentially from the base plate 15, and the side plates 17 extend smoothly and tangentially from upper ends of the curved portions 16. A tab 30 of a mating terminal can be inserted into the terminal connecting portion 11 from the front.

Specifically, as shown in FIGS. 2 to 5, a front edge 15F of the base plate 15 and front edges 16F of the curved portions 16 are substantially continuous and flush with each other and hence are at substantially the same position in forward and backward directions. Front edges 17F of the side plates 17 and a front edge 18F of the upper wall 18 also are substantially continuous and flush with each other, and hence are at substantially the same position in forward and backward directions. However, the front edges 17F of the side plates 17 are more forward than the front end edges 15F, 16F of the base plate 15 and the curved portions 16 so that parts of the side plates 17 adjacent the front edges 17F of the side plates 17 define protecting portions 19 for protecting a turned portion 21 of a resilient contact piece 20 to be described later at both left and right sides. The front edges of the protecting portions 19 (i.e. the front end edges 17F of the side plates 17) are located before the turned portion 21.

Figure 4:
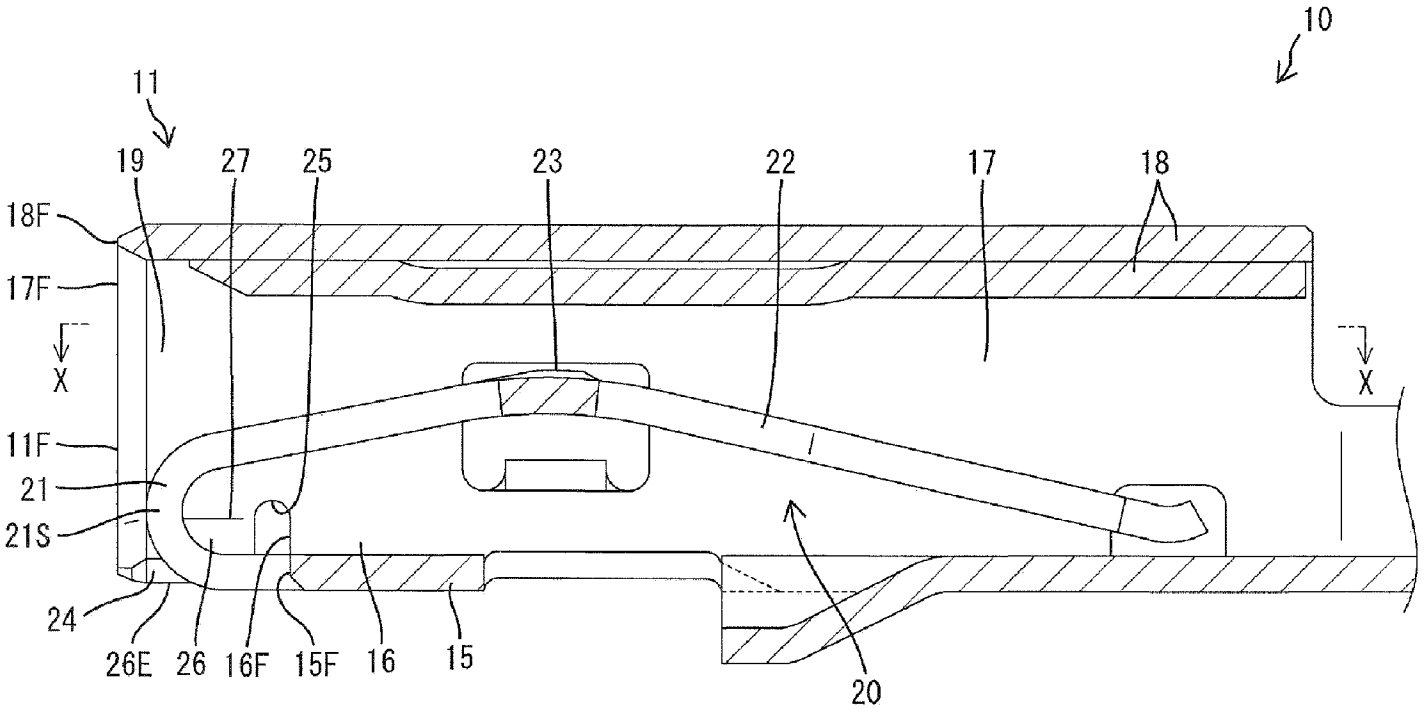
FIG. 4 is a section of the terminal fitting.
Figure 5:
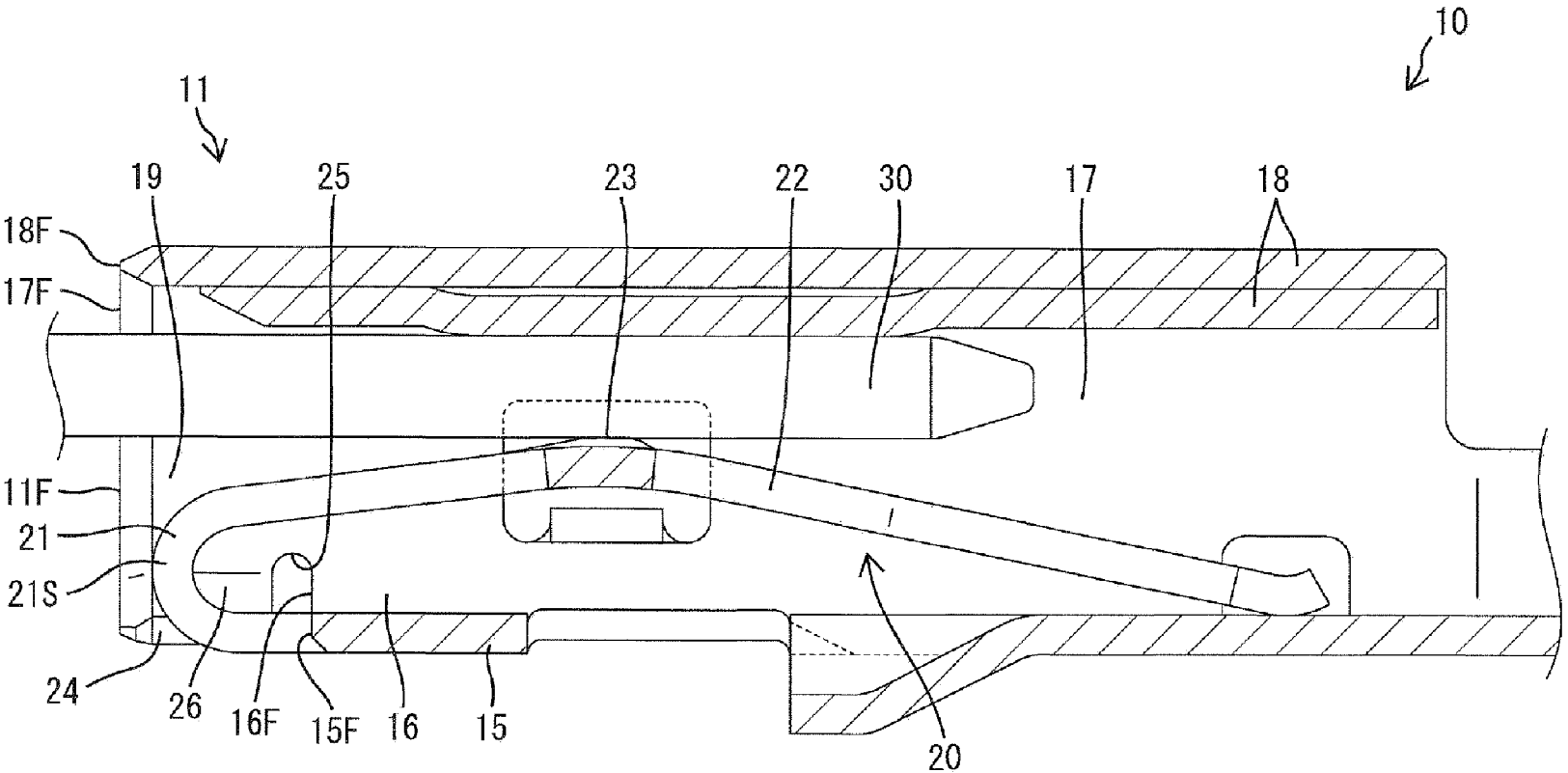
FIG. 5 is a section showing a state where a tab is inserted in a terminal connecting portion.

As shown in FIGS. 1, 2, 4 to 6, the resilient contact piece 20 is cantilevered from the front edge 15F of the base plate 15 and is folded back and into the terminal connecting portion 11. The resilient contact piece 20 includes the arcuately bent turned portion 21 extending forward from the front edge 15F of the base plate 15 and a main portion 22 extending back from the extending end of the turned portion 21. As shown in FIGS. 4 and 5, the main portion 22 is bent to have a mountain or pointed shape when viewed sideways, and a contact 23 is at the peak or innermost part of the main portion 22. As shown in FIG. 5, the tab 30 inserted in the terminal connecting portion 11 is held between the inner surface (lower surface) of the upper wall 18 and the upper surface of the contact 23 of the resilient contact piece 20 from upper and lower sides and is connected electrically conductively to the terminal fitting 10 at a specified contact pressure by a resilient restoring force of the resilient contact piece 20.

Figure 6:
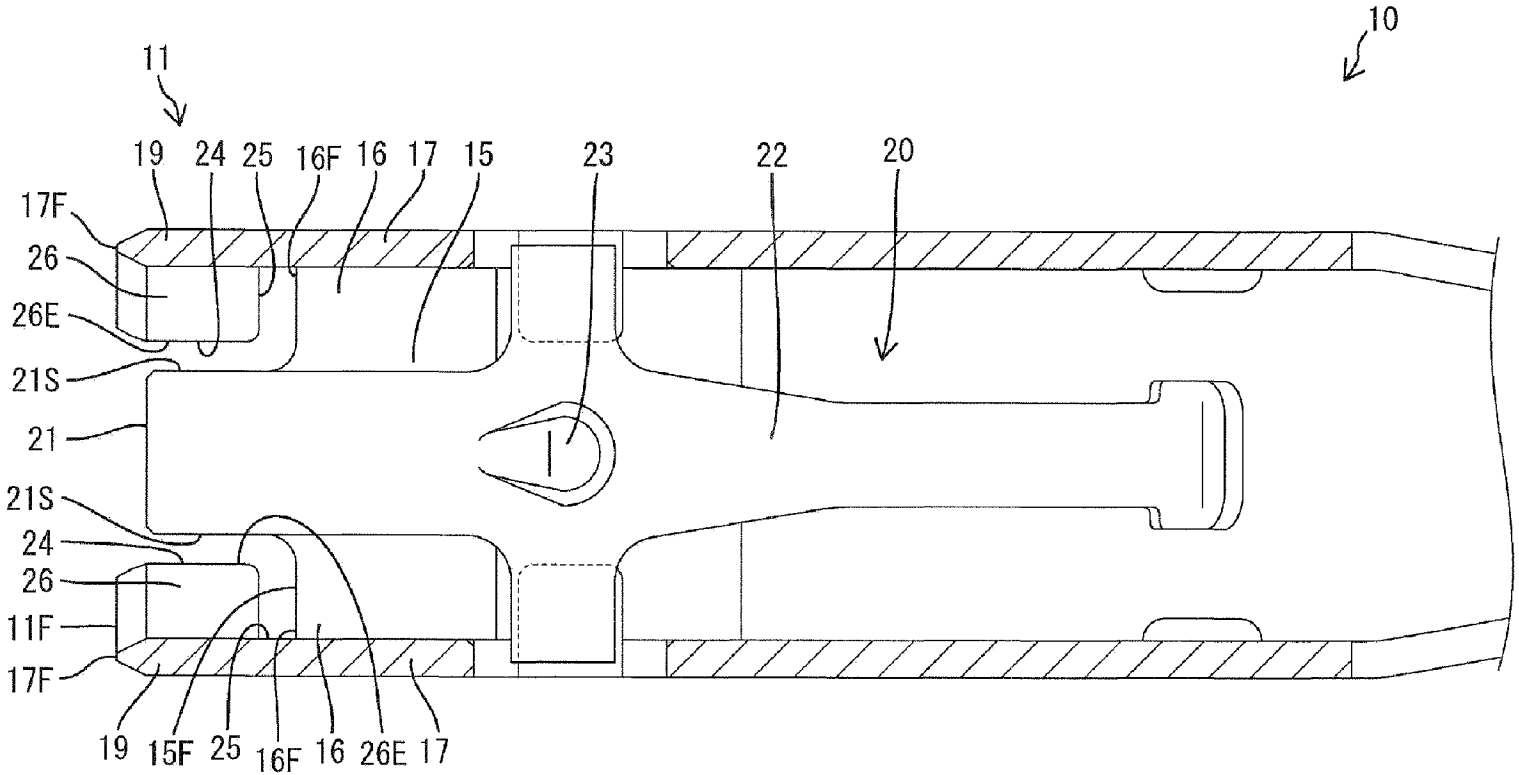
FIG. 6 is a section along X-X of FIG. 4.
Figure 7:
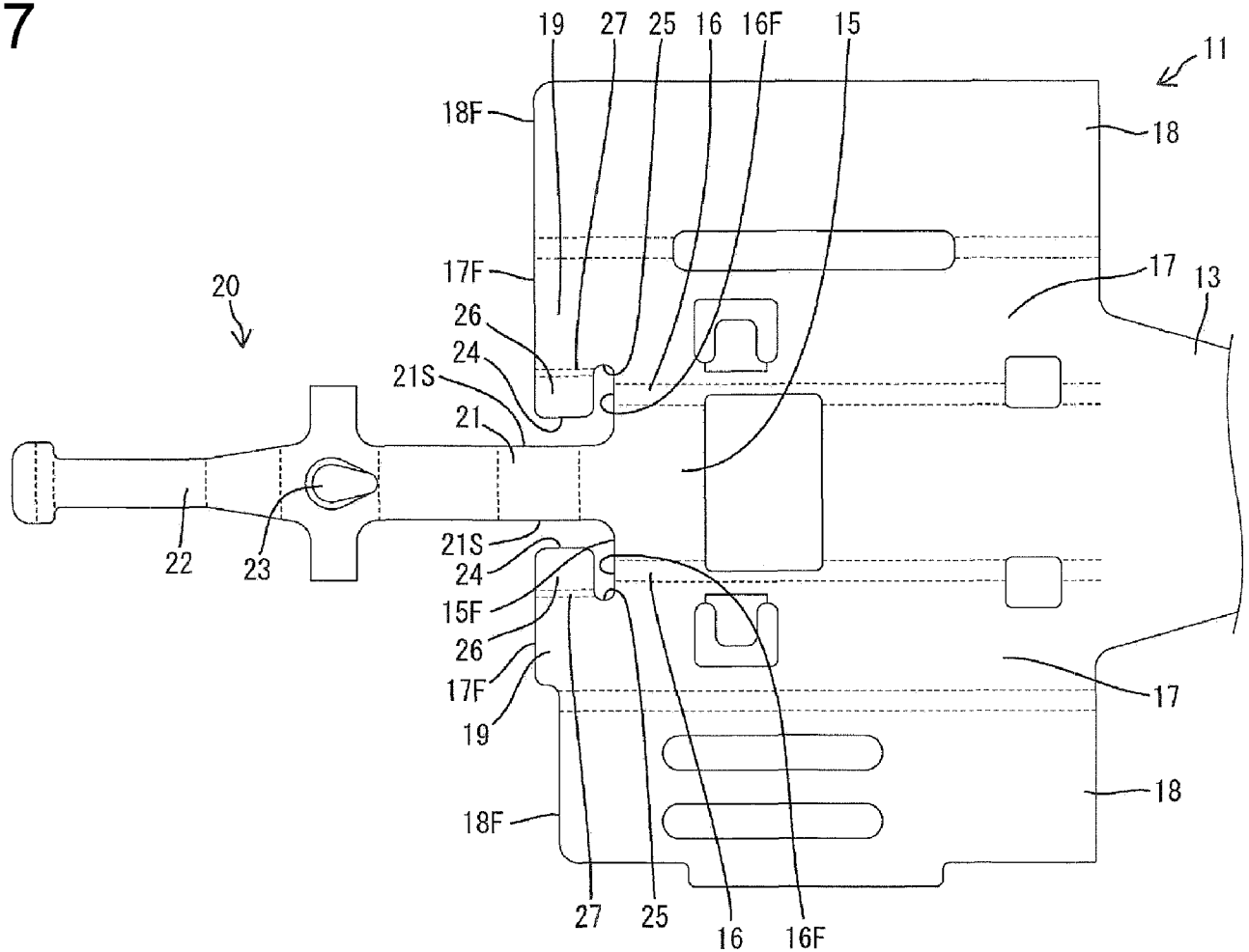
FIG. 7 is a development view of the terminal fitting.
Figure 8:
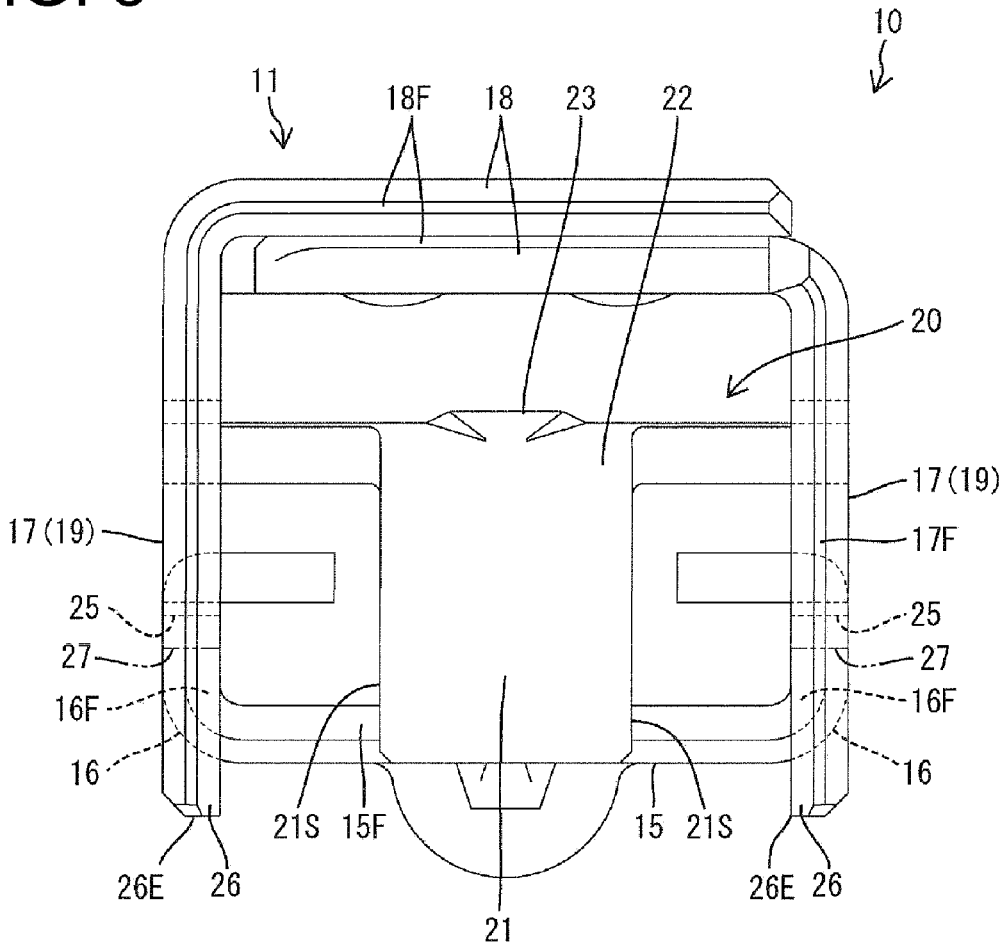
FIG. 8 is an imaginary front view showing a state before protecting plate portions are bent.
Figure 9:
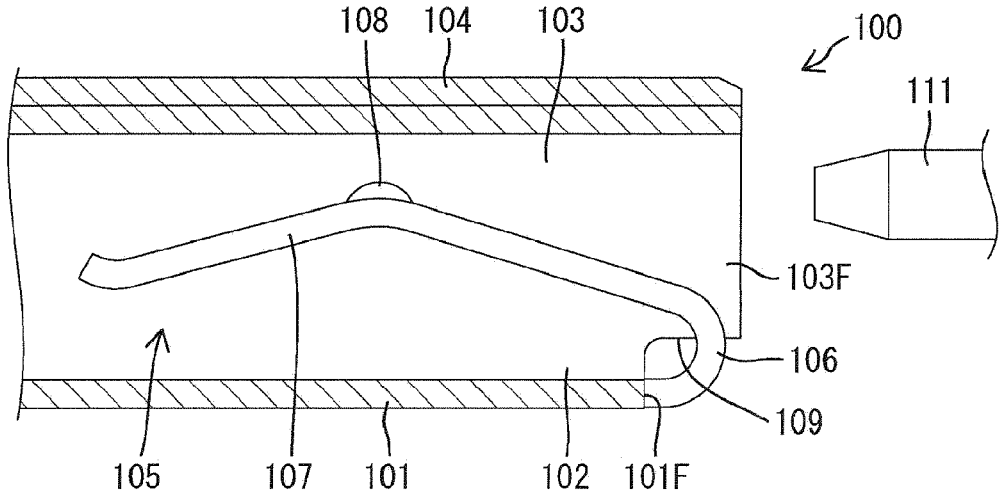
FIG. 9 PRIOR ART
FIG. 9 is a section of a conventional terminal fitting.
Figure 10:
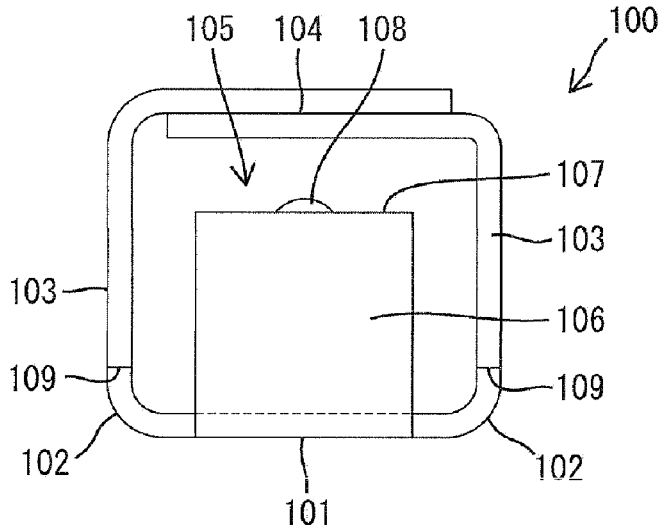
FIG. 10 PRIOR ART
FIG. 10 is a front view of the conventional terminal fitting.
Figure 11:
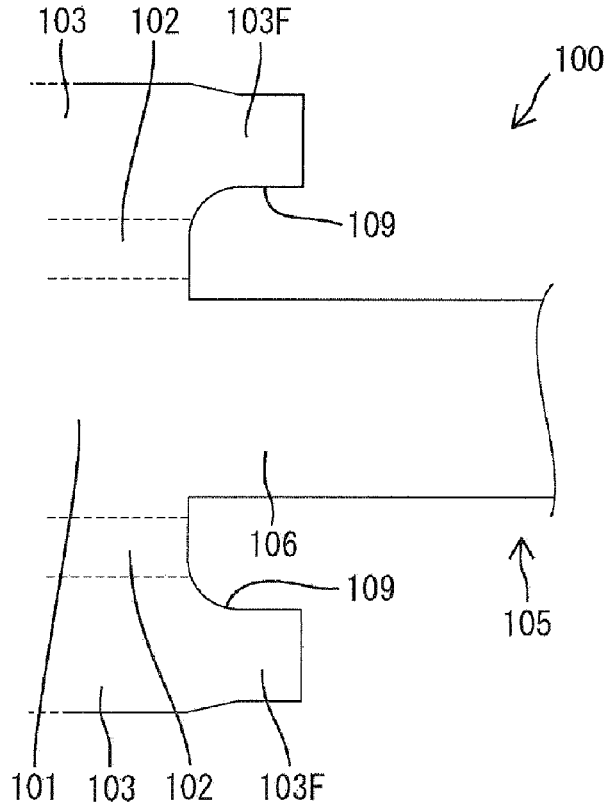
FIG. 11 PRIOR ART
FIG. 11 is a development view of the conventional terminal fitting.
Figure 12:
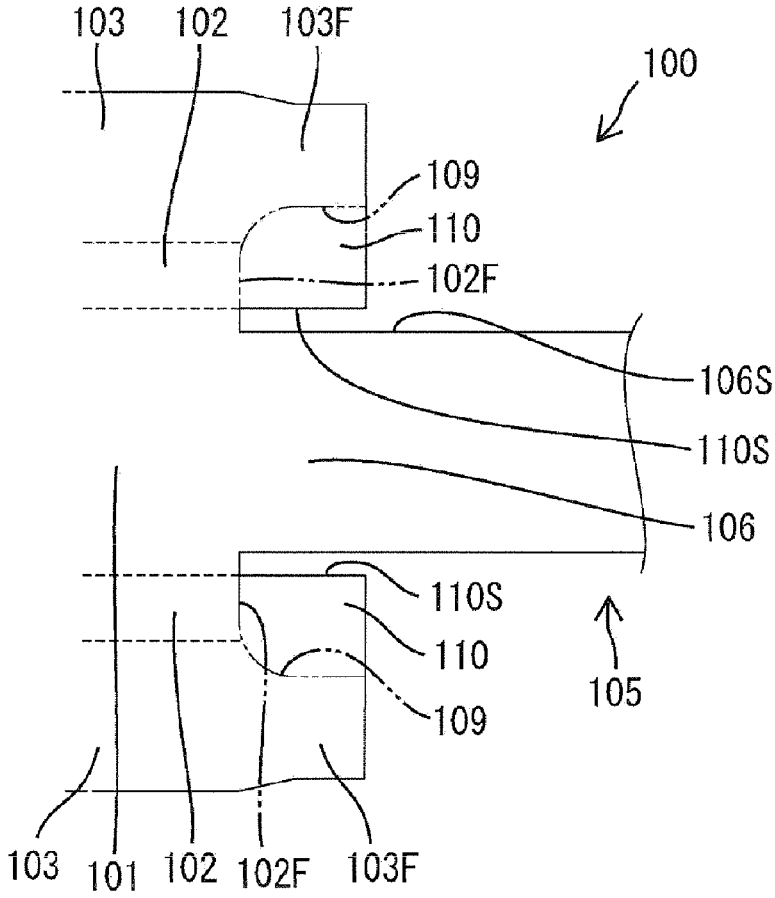
FIG. 12 PRIOR ART
FIG. 12 is a development view showing an example of a change in the developed shape of the conventional terminal fitting.

As shown in FIGS. 1, 2, 4 to 6, a front part of the terminal connecting portion 11 is formed with first slits 24 extending back from the front edge 11F of the terminal connecting portion 11 along left and right lateral edges 21S of the turned portion 21. Second slits 25 extend from the rear ends of the respective first slits 24 substantially along the front edge 15F of the base plate 15 and the front edges 16F of the curved portions 16. Protecting plates 26 are defined by the respective first and second slits 24, 25 and are cantilevered substantially toward the turned portion 21. As shown in FIGS. 3 and 6, formation areas of the first slits 24 in forward and backward directions extend substantially from the front edge 11F of the terminal connecting portion 11 to the front edges 15F, 16F of the base plate 15 and the curved portions 16. As shown in FIGS. 1 and 8, formation areas of the second slits 25 in a direction substantially perpendicular to forward and backward directions extend from the lateral edges 21S of the turned portion 21 toward the bottom ends of the side plates 17 including the entire curved portions 16.

As shown in FIGS. 1, 3 and 6, the protecting plates 26 are located at sides of and adjacent to the first slits 24 substantially opposed to the opposite sides of the turned portion 21, i.e. arranged at the opposite sides of the turned portion 21 in a width direction. Further, as shown in FIGS. 3 to 6, the protecting plates 26 are forward of the second slits 25 and substantially opposite to the base plate 15 and the curved portions 16 in forward and backward directions. The protecting plates 26 are substantially planar and are bent along folding lines 27 (see FIGS. 1, 2, 4, 5 and 7) at boundaries between the curved portions 16 and the side plates 17 to extend in directions oblique to both the side plates 17 and the base plate 15. The positions of the folding lines 27 in a vertical direction are slightly below the upper ends of the second slits 25.

As shown in FIGS. 1, 2, 4 and 5, the protecting plates 26 extend obliquely down along the second slits 25 from the front end portions (protecting portions 19) of the side plates 17 projecting forward from the front end edges of the base plate 15 and the curved portions 16. The protecting plates 26 extend in substantially toward the turned portion 21 in the width direction and toward the base plate 15 in the vertical direction. As shown in FIG. 1, lower extending end edges 26E of the protecting plates 26 are located within the thickness range of the base plate 15 and slightly above the outer surface of the bottom end of the turned portion 21. In the width direction parallel to the base plate 15, the lower extending edges 26E of the protecting plates 26 are located inwardly of the curved portions 16 and near the left and right lateral edges of the turned portion 21.

FIG. 8 shows an imaginary state where the terminal connecting portion 11 is formed into a rectangular tubular shape without bending the protecting plates 26 along the folding lines 27 (i.e. with the protecting plates 26 kept substantially continuous and flush with the front ends of the side plates 17). The lower edges 26E of the protecting plates 26 are below and outwardly of the base plate 15 in a state where the protecting portions 26 are not bent. However, the protecting plates 26 actually are bent obliquely in along the folding lines 27 above the curved portions 16 and are located entirely inward of the outer surfaces of the curved portions 16 when viewed from the front.

The turned portion 21 of the resilient contact piece 20 projects forward from the front edge 15F of the base plate 15. However, the protecting plates 26 are located before the front edge 15F of the base plate 15 to prevent external matter from entering the terminal connecting portion 11 and to prevent external interference with the turned portion 21. That is, as shown in FIG. 4, an area of the turned portion 21 below the front ends of the protecting portions 19 of the side plates 17 is covered at least partly by the protecting plates 26 when viewed sideways so that external matter cannot interfere with the turned portion 21 from lateral sides. The lower edges 26E of the protecting plates 26 prevent external matters from interfering with the turned portion 21 from below.

The protecting plates 26 are substantially flat plates bent along the folding lines 27 that extend in forward and backward directions. Thus, the protecting plates can be formed easily as compared with the case where they are bent at plural positions or bent arcuately along the curved portions 16. Further, the protecting plates 26 are separated from the curved portions 16 via the second slits 25 and will not be deformed due to strain caused by forming the curved portions 16.

The invention is not limited to the above described and illustrated embodiment. For example, the following embodiments also are included in the scope of the invention.

The protecting plates extend oblique to the side plates and the base plate in the above embodiment. However, they may be substantially perpendicular to the side plates and parallel to the base plate.

The protecting plates are substantially planar in the above embodiment. However, they may be bent at plural positions e.g. to conform to the curved shapes of the curved portions or may be arcuately curved along the curved portions.

The extending ends of the protecting plates are located within the thickness range of the base plate in the above embodiment, but they may be located inwardly of (above) the inner surface (upper surface) of the base plate.

The extending ends of the protecting plates are located inwardly of the curved portions (in the area corresponding to the base plate portion) in the width direction parallel to the base plate in the above embodiment. However, they may be located in areas corresponding to the curved portions in the width direction parallel to the base plate.

Front ends of the base plate and the curved portions are substantially continuous and flush with each other in the above embodiment. However, the front ends of the curved portions may be located before or behind the front end of the base plate. In this case, the protecting plates are located at least partially before the front end of the base plate and can reliably protect the turned portion.

The folding lines of the protecting plates are substantially at the positions lower than the upper ends of the second slits (positions close to the base plate) in the above embodiment, but they may be at the same height as the upper ends of the second slits.

The protecting plates are inward of the outer surfaces of the curved portions when viewed from the front in the above embodiment. However, they may partially project outward from the outer surfaces of the curved portions.

What is claimed is:

1. A terminal fitting, comprising:

a base plate having a front end and opposite first and second lateral sides extending rearward from the front end;

first and second curved portions extending respectively from the first and second sides of the base plate, the curved portions having front ends substantially aligned with the front end of the base plate;

first and second opposed side plates projecting respectively from the first and second curved portions and aligned substantially normal to the base plate, the side plates having front ends forward of the front ends of the base plate and the curved portions;

a ceiling extending between the side plates substantially parallel and opposed to the base plate;

a resilient contact including a turned portion cantilevered from the front end of the base plate and curved rearward and a main portion extending back from the turned portion into a space between the base plate and the ceiling and between the side plates; and first and second protecting plates cantilevered respectively from the first and second side plates along folding lines aligned substantially parallel to the base plate, the protecting plates being forward of the front ends of the base plate and the curved portions and extending obliquely toward the turned portion for protecting the turned portion, the protecting plates having extending end edges opposite the folding lines, the extending end edges being within a thickness range of the base plate when viewed from the front, the protecting plates further having front edges forward of the turned portion of the resilient contact and rear edges rearward of the turned portion of the resilient contact, at least part of the rear edges of the protecting plates being in opposed facing disposition to the front ends of at least one of the base plate and the curved portions for substantially impeding engagement with the resilient contact laterally or from below.

2. The terminal fitting of claim 1, wherein the folding lines between the protecting plates and the side plates are at height positions between the curved portions and the ceiling.

3. The terminal fitting of claim 1, wherein the base plate, the curved portions, the side plates and the ceiling define a tube with an open front.

4. The terminal fitting of claim 3, wherein the protecting plates are substantially planar.

5. The terminal fitting of claim 3, wherein the extending end edges of the protecting plates are inward of the curved portions and proximate to lateral edges of the turned portion.

* * * * *